United States Patent [19]

Cotterill

[11] Patent Number: 4,691,888

[45] Date of Patent: Sep. 8, 1987

[54] KEYBOARD SUPPORT

[76] Inventor: Michael J. Cotterill, 43 Rocklea Crescent, Sylvania Heights, New South Wales 2224, Australia

[21] Appl. No.: 773,552

[22] Filed: Sep. 9, 1985

[51] Int. Cl.[4] ..... A47B 57/06

[52] U.S. Cl. ..... 248/284; 248/1; 108/96; 108/1

[58] Field of Search ..... 248/284, 276, 274, 286, 248/287, 1 C, 1 H, 1 I, 1 B, 421, 281.1; 400/682; 108/96, 106, 1, 72, 76

[56] References Cited

U.S. PATENT DOCUMENTS

| | | | |
|---|---|---|---|
| 2,822,229 | 2/1958 | Carlson | 248/284 X |
| 3,032,304 | 5/1962 | Machlan | 248/284 X |
| 3,079,726 | 3/1963 | May | 108/96 X |
| 3,995,797 | 12/1976 | Knight | 248/281.1 X |
| 4,118,766 | 10/1978 | Kredo | 248/284 X |
| 4,384,532 | 5/1983 | Staff | 108/96 X |
| 4,496,200 | 1/1985 | Hagstrom | 248/1 B |
| 4,515,086 | 5/1985 | Kwiecinski et al. | 108/96 |

*Primary Examiner*—Ramon S. Britts
*Assistant Examiner*—Karen J. Chotkowski
*Attorney, Agent, or Firm*—Pearne, Gordon McCoy & Granger

[57] ABSTRACT

Apparatus for supporting a keyboard from a desk comprises a mounting bracket (1) adapted to be fastened to the underside of a desk top (7), a keyboard support bracket (4) to which a keyboard or support platform (8) may be mounted. Brackets (1,4) are connected by a mechanism which permits bracket 4 to be raised or lowered (FIG. 3 members 10,20 pivotally mounted at 12, 13, 21, 26) and to be tilted (pin 26, slot 25).

Adjustment of attitude and of tilt are both enabled and disabled by means of a single control for example a screwed clamp wheel mounted on threaded clamp bolt 30 which when unclamped slides in slots 30 & 37.

11 Claims, 8 Drawing Figures

KEYBOARD SUPPORT

FIELD OF THE INVENTION

This invention relates to a computer keyboard supporting mechanism.

BACKGROUND ART

Desks or workstations specifically intended to support a computer keyboard and a visual display unit are now well known. Some include means for adjusting the working height of the keyboard. Some also, or instead, include provision for adjustably tilting the keyboard. It is usually not as simple as is desired to alter the height and tilt of a keyboard to suit an individual operator since altitude and tilt each require adjustment of separate controls. Moreover most adjustment mechanisms involve structural modification of the desk or workstation framework and cannot readily be incorporated in existing furniture or undesirably intrude into space beneath the keyboard thereby restricting the knee room available or the clearance required for a keyboard operator to swivel.

An object of the present invention is to overcome or at least ameliorate some of the disadvantages of the prior art.

DISCLOSURE OF THE INVENTION

According to one aspect the invention consists in apparatus comprising keyboard support means, a mounting bracket adapted in use to mount the apparatus to a stationary support, and a linkage system connecting the keyboard support means and the mounting bracket, said linkage system in use permitting adjustment of the altitude of the keyboard support means relative to the stationary support and permitting adjustment of tilt of the keyboard support means about a horizontal axis, said apparatus being characterized in that both said adjustment of altitude and said adjustment of tilt are enabled or disabled by a single control.

BRIEF DESCRIPTION OF DRAWINGS

Embodiments of the invention will now be more particularly described by way of example only with reference to the accompanying drawings in which.

EMBODIMENTS OF THE INVENTION

Figure 1:
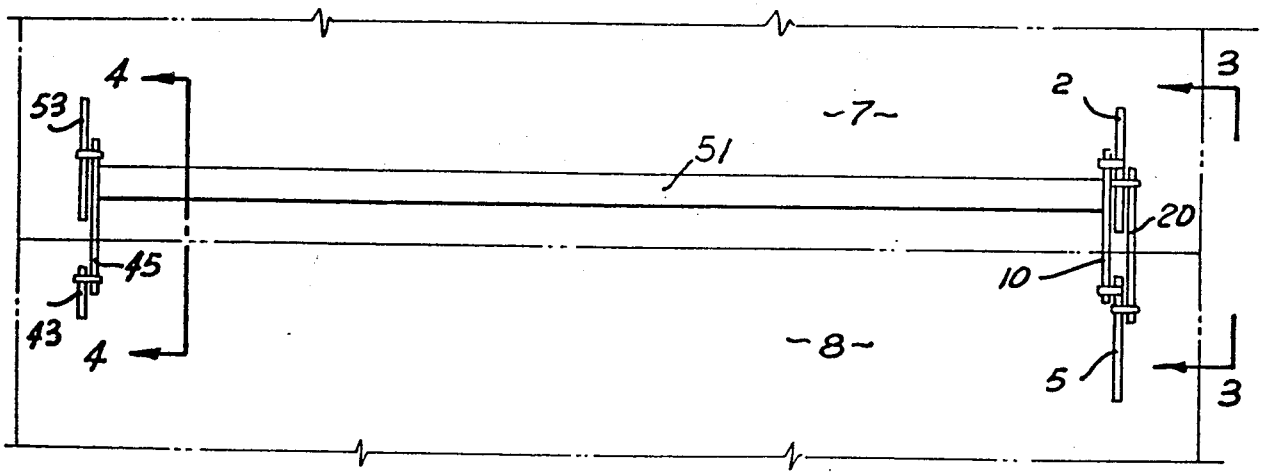
FIG. 1 shows a first embodiment in plan.
Figure 2:
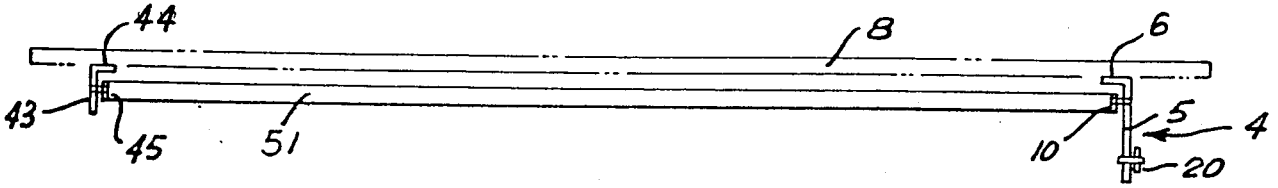
FIG. 2 shows the embodiment of FIG. 1 in front elevation.
Figure 3:
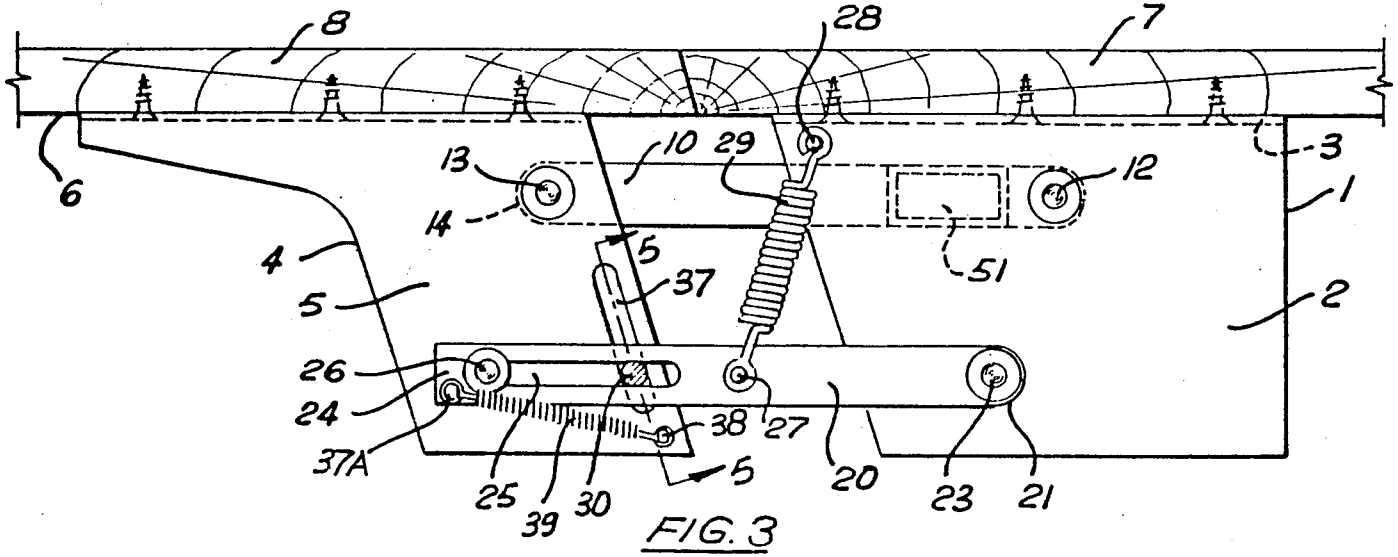
FIG. 3 shows the embodiment of FIG. 1 in side elevation viewed as on line 3—3 FIG. 1.
Figure 4:
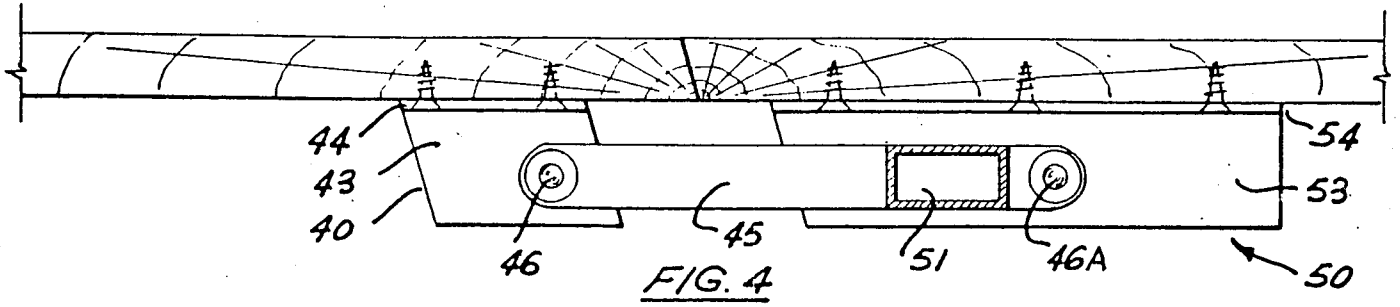
FIG. 4 shows the embodiment of FIG. 1 in section viewed as on line 4—4 of FIG. 1.

With reference to FIGS. 1 to 6 there is shown a mechanism for supporting a keyboard from a desk or work station.

The mechanism consists in a mounting bracket 1 of inverted "L" shaped cross-section when viewed from the front and which comprises a side plate 2 and a flange 3 provided with screw holes whereby the mounting bracket 1 may be mounted below a stationary support such as a desk surface 7 or table top.

A keyboard support means comprises a bracket 4 also of inverted "L" shaped cross-section, which has a side plate 5 and a flange 6 provided with screw holes for attachment of bracket 4 to the underside of a keyboard or of a keyboard platform 8.

For preferance keyboard platform 8 is a timber or reinforced plastic worktop and is provided with a non-slip upper surface.

Mounting bracket 1 is connected to the keyboard support bracket 4 by a linkage system including an upper connecting member 10 and a lower connecting member 20.

Upper member 10 is pivotally connected by means of a headed pin 12 at or adjacent one member end to side plate 2 of mounting bracket 1 and is pivotally connected at or adjacent the other member end by means of pin 14 to side plate 5 of keyboard support 4.

Lower member 20 is pivotally mounted at or near one member end 21 to side plate 2 of mounting bracket 1 by means of pin 23 and has a slot longitudinally extending from adjacent the other end 24 towards pin 23.

Lower member 20 is pivotally connected with keyboard support means of a headed pivot pin 26 of which the shank extends through an apperture of side plate 5, through slot 25, and which has a retaining head or flange of greater width than slot 25.

A spring 29 is connected to lower member 20 by means of spring retaining lug 27 situated at or near the member mid point and extends to spring retaining lug 28 at or near flange 3 of mounting bracket 1. Members 20 and 10 are substantially parallel and together with side plates 2 and 5 constituted a four bar linkage such that when mounting bracket 1 is fixedly mounted to stationary support desk 7, keyboard support bracket 4 is movable upwards or downwards relative to desk 7 by swing movement of members 10 and 20 about the horizontal axis of pins 12 and 23. Pin 14 permits movement of keyboard support bracket 4 pivotally with respect to member 10 about a horizontal axis enabling tilt adjustment of keyboard platform 8.

Tilting of keyboard platform 8 is accomodated by movement of pivot pin 26 slidably with respect to slot 25 of member 20.

A spring 39 extends from spring retaining lug 37 located near the lower corner of side plate 5 closest to pivot 23 to retaining lug 37*a* near end 24 of member 20. Spring 39 biases keyboard platform 8 toward a substantially horizontal orientation while spring 29 biases keyboard support bracket 4 towards a position in which flanges 3 and 6 are substantially coplanner that is to say in which keyboard support platform 8 is substantially level with table top 7.

Figures 5, 6:
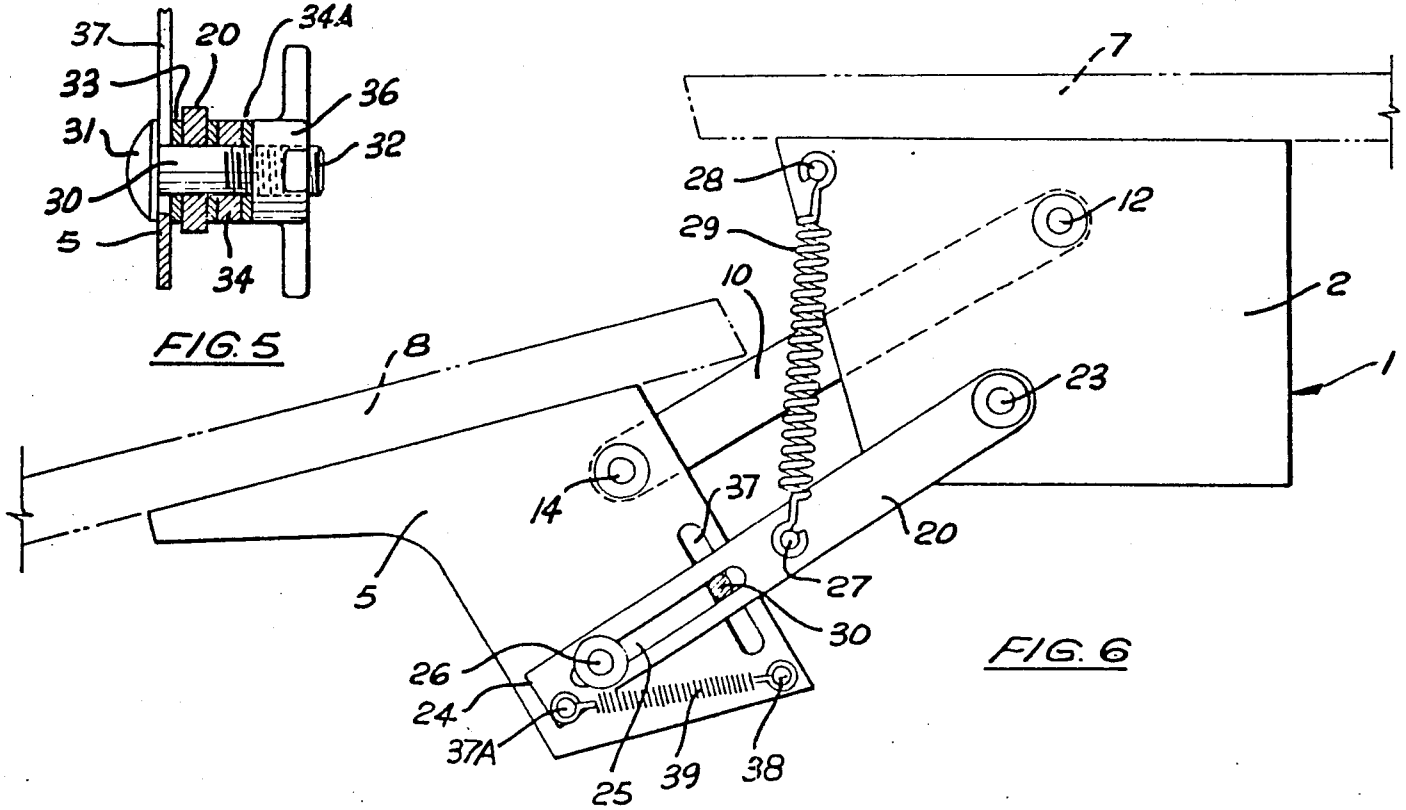
FIG. 5 shows a portion of the embodiment of FIG. 1 in cross section viewed as on line 5—5 of FIG. 1.
FIG. 6 shows the embodiment of FIG. 1 when in a configuration different from that shown in FIG. 3.

A locking clamp assembly shown in more detail in FIG. 5 comprises a coach bolt 30 having a head 31 and a partly threaded stem 32 which extends through upwardly extending slot 8 of side plate 5, through a compression washer 33, through slotted apperture 25 of member 20, through a spacer washer 34, a spring washer 34*a*, and into a threaded socket of a handle or triwheel 36, (handle 36 is omitted from FIGS. 1 to 4 and 6 for clarity).

By turning handle 36 lower member 20 and washer 33 may be screw clamped in tight abutment with side plate 5 preventing both upward and downward movement of the mechanism and also preventing tilting movement of keyboard platform 8.

Slot 38 accommodates relative movement of member 20, side plate 5 and the locking clamp assembly during adjustment of or altitude of keyboard platform 8 relative to desk top 7 when, for example, the keyboard platform is maintained in a horizontal disposition.

In the preferred embodiment keyboard support bracket 4 is connected to a second keyboard support bracket 40 laterally spaced from bracket 1 by means of platform 8. Support bracket 40 has a downwardly extending side plate 43 and a mounting flange 44 adapted to be secured to a keyboard platform 8.

Similarly mounting bracket 1 is connected to a second mounting bracket 50 spaced laterally apart from mounting bracket 1 by means of the desk top 7 and by a distance corresponding substantially to the spacing between brackets 4 and 40.

Bracket 50 has a downwardly extending side plate 53 and a mounting flange 54 adapted for screw fastening of bracket 50 to the undersurface of desk top 7.

Brackets 40 and 50 are pivotally connected by an arm member 45 connected by pivot pin 46 to keyboard bracket side plate 43 and by pivot **46*a* to support bracket side plate 53**.

Member 45 is substantially parallel to member 10 and is connected by a hollow, tubular crossbar 51. Side plates 43 and 53 do not need to extend downwardly to the same extent as side plates 2 and 5 and thus provide more clearance below brackets 40 and 50 for a keyboard operator to swivel than exists below brackets 1 and 4.

For preference spring 29 is of heavier duty than spring 39.

Members 10 and 20 may be disposed on opposite sides of side plates 1 and 4 as shown in FIGS. 1 to 6.

For preference also the forward edges of the keyboard output bracket are provided with a rubber or plastic protective sheath.

Member 20 is a first member to which keyboard support means 4 is connected for pivotal motion about a first axis, that of pin 26.

Member 20 is pivotally connected to mounting bracket 1 for pivotal motion about a second axis, that of pin 23, parallel to the axis of pin 26. Member 10 is a second member connected to mounting bracket 1 for pivotal motion about a third axis, that of pin 12, which is spaced from pin 23. Member 10 is connected to keyboard support bracket 4 by means of pin 14 which defines a fourth axis parallel to the first axis.

In use a keyboard is mounted directly to flanges 6 and 44 or else placed on a keyboard support platform 8.

By turning handle 36 to unclamp the linkage parts, the keyboard or support platform 8 can be raised or lowered and can be tilted relative to desk top 7. When a desired altitude and angle of tilt is achieved further upward and downward adjustment and further tilting can both be prevented by turning handle 36 to reclamp the parts.

The clamp assembly can be released with one hand, the other hand being used to achieve a desired adjustment against the bias of springs 29 and 39. Springs 29 and 39 support the keyboard during adjustment when clamp 36 is released.

The apparatus may be retro-fitted to many existing desks or tables and does not require a special desk frame. Moreover sufficient clearance is generally available below bracket 40 to permit a keyboard operator sitting at a keyboard to swivel.

Figure 7:
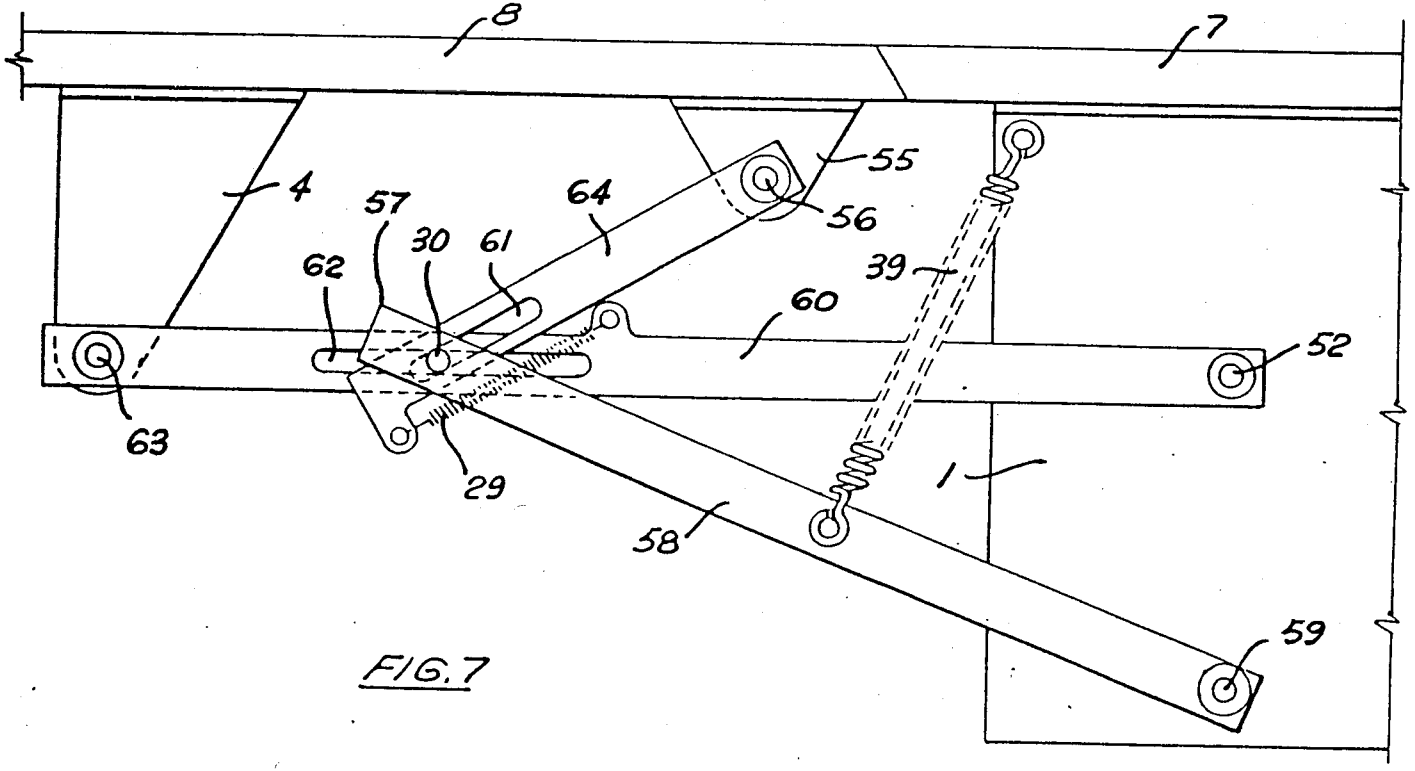
FIG. 7 shows schematically a second embodiment of the invention in side elevation.

With reference to FIG. 7 there is shown an embodiment having parts corresponding in function to those of FIGS. 1 to 6 except insofar as hereinafter described.

In the embodiment of FIG. 7, keyboard support bracket 4 is pivotally connected with mounting bracket 1 by means of arm 60. Arm 60 is connected to mounting bracket 1 at pin 52 and to bracket 4 at pin 63. A first strut 64 is pivotally connected to platform 8 by means of a rear bracket 55 and pivot pin 56, a second strut 58 is pivotally connected to mounting plate 1 by means of pivot pin 59 which is spaced apart from and below pivot pin 52.

Arm 60 and first strut 64 are each slotted. Pin 30 of a clamp assembly similar to that previously described with reference to FIG. 5 pierces the free end 57 of second strut 58 and extends through slot 62 of arm 60 and slot 61 of strut 64.

When a triwheel is screwed tight on pin 30, arm 60 strut 58 and strut 64 are clamped to each other and the mechanism is immobilized. When the parts are unclamped, arm 60 is able to swing about pivot 52 permitting the platform to the raised or lowered in altitude and platform 8 is free to tilt about pivot pin 53 as required.

For preferance clamp pin 30 has a threaded handle at one end and at the other end has a square shoulder adapted for translation in the slot 62.

Spring 29 and 39 are preferably provided to bias the platform towards a horizontal tilt orientation and to bias the platform towards a level or raised position relative work surface 7.

Figure 8:
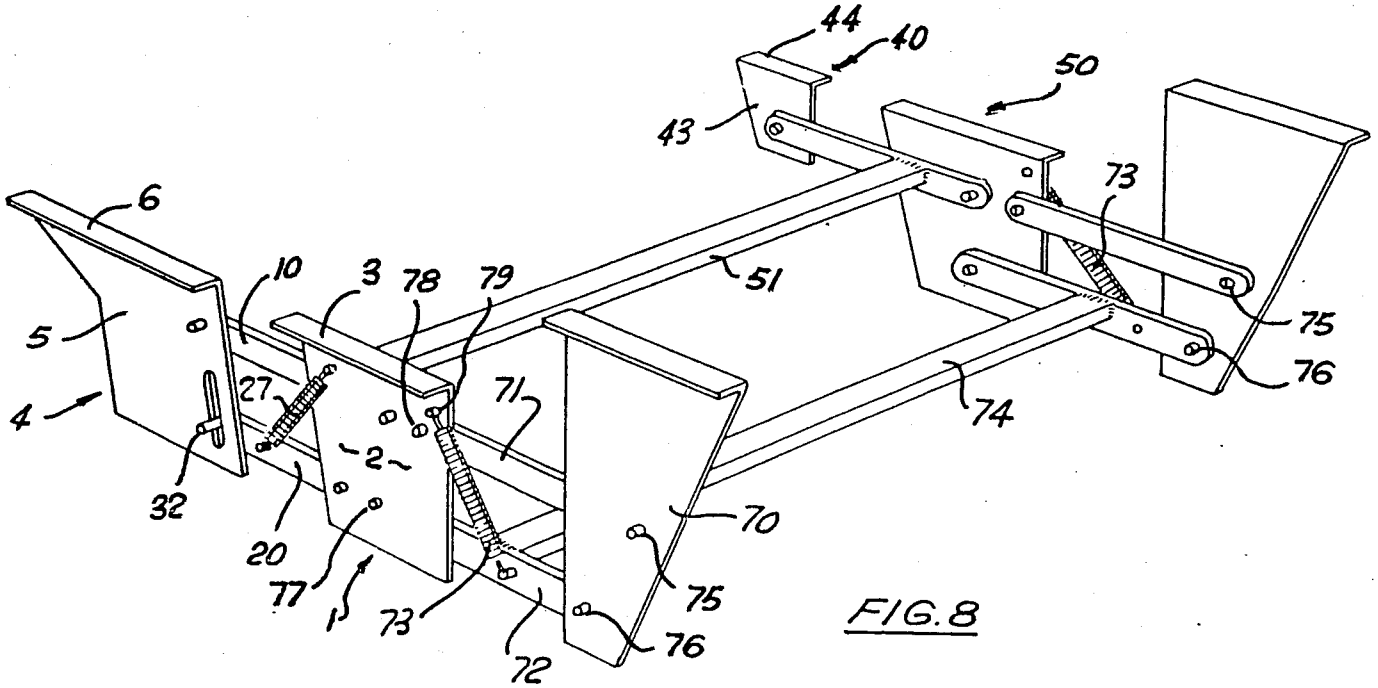
FIG. 8 shows of a third embodiment of the invention in isometric view.

With reference to FIG. 8 there is shown a further embodiment in which parts of similar function to those of the first embodiment are identified by like numerals. In the embodiment shown in FIG. 8, brackets 70 are provided for supporting a VDU unit above the desk surface. VDU support brackets 70 are intended to project upwardly through apropriate slots to be cut in desk top 7.

VDU support brackets 70 are supported from mounting brackets 1, 5 by means of pantograph arms 71, 72 pivotally connected to bracket 70 at one end by means of pivot pins 75, 76 and to support bracket 1 at the other by means of pivot pins 77, 78 VDU brackets 70 are biased towards a raised position by a spring 73 extending from a lug near the upper edge of side plate 1 to a lug **79*a* on lower pantograph arm 72**.

If desired a clamp arrangement similar to or differing from that described for the keyboard support mechanism may be provided to lock the VDU brackets at a desired height.

Although prefered embodiments of the invention are designed for fitting to existing desks or tables, the mechanism can be built into furniture and parts of the furniture can be used as mounting brackets. For example members 10 and 20 could be pivotally mounted desk legs or other parts which perform the function of mounting side plates 2 in the embodiment of FIG. 1 described.

Similarly brackets 1 can be adapted for mounting to surfaces other than the underside of the table or desk top without departing from the invention hereof.

As will be apparent to those skilled in the art from the teaching hereof, the invention herein disclosed may be embodied in other forms, and such variations are deemed to be within the scope hereof.

I claim:

1. Keyboard support apparatus comprising keyboard support means, a mounting bracket adapted in use to mount the apparatus to a stationary support, and a linkage system connecting the keyboard support means and the mounting bracket, said linkage system including first means permitting adjustment of the altitude of the keyboard support means relating to the stationary support and including second means permitting adjustment of tilt of the keyboard support means about a horizontal axis, the adjustment of said first means being independent of the adjusted tilt of said keyboard support means and the adjustment of said second means being independent of the adjusted altitude of said keyboard support means, and single control means connected to said linkage system for enabling or disabling both said adjustment of altitude and said adjustment of tilt, said keyboard support means including a keyboard support bracket connected to a first member for pivotal motion about a first axis, the first member being pivotally connected to the mounting bracket for swing motion about a second axis parallel to the first; a second member parallel to the first member and connected to the mounting bracket for pivotal motion about a third axis parallel to and spaced from the second axis, the second member being connected to the keyboard support bracket for pivotal motion about a fourth axis parallel to the first, said members with said brackets forming a four bar linkage and comprising said linkage system and said single control means including clamping means for locking the four bar linkage against movement, the keyboard support bracket being pivotally connected to the first member by slidably cooperating pin means and slot means.

2. Apparatus according to claim 1 wherein the clamping means includes complementary threaded parts screw engageable to clamp parts of the linkage system against movement.

3. Apparatus according to claim 2 wherein the threaded parts include a stem which passes through a slot in the first or second member and through a slot in the keyboard support means.

4. Apparatus according to claim 1 wherein the linkage system includes means resiliently biasing the keyboard support means towards a position which in use is substantially untilted.

5. Apparatus according to claim 4 wherein the linkage system includes means resiliently biasing the keyboard support means towards a position which in use is a raised position.

6. Apparatus according to claim 1 comprising a pair of connected laterally spaced mounting brackets and a pair of connected laterally spaced keyboard supporting brackets.

7. Apparatus according to claim 6 wherein a mounting bracket is of inverted "L" cross section and has a side plate which in use is downwardly extending.

8. Apparatus according to claim 7 wherein a mounting bracket is attached to the undersurface of a desk or table.

9. Apparatus according to claim 8 further including a platform mounted to the keyboard support bracket.

10. Apparatus according to claim 1 further including a VDU support bracket connected to the mounting bracket by a pantographic linkage.

11. A keyboard support apparatus comprising a keyboard platform held by a tiltable and vertically movable support bracket, a linkage system connecting said bracket to a stationary support frame by a pair of lower and upper connecting members parallelly disposed to each other and pivotally secured at their one end to said frame and at their opposite ends to said bracket for vertical movement of said bracket, an elongated slot in said lower member and a substantially vertical slot in said bracket, a pivot pin passing through each of said slots, and clamping means on said pin to adjustably fix the relative position of said lower member to said bracket.

* * * * *